US005533219A

United States Patent [19]

Meyers

[11] Patent Number: 5,533,219

[45] Date of Patent: Jul. 9, 1996

[54] STADIUM SEAT CUSHION

[76] Inventor: John D. Meyers, 5544 NE. Penrith Rd., Seattle, Wash. 98105

[21] Appl. No.: 417,217

[22] Filed: Apr. 5, 1995

[51] Int. Cl.[6] ..... A47C 16/00

[52] U.S. Cl. ..... 5/653; 5/656; 297/283.1; 297/250.1

[58] Field of Search ..... 5/420, 653, 654, 5/655, 474; 297/219.1, 287.1, 250.1, 256.1, 256.12, 256.16; 52/8

[56] References Cited

U.S. PATENT DOCUMENTS

| | | | |
|---|---|---|---|
| 2,059,875 | 11/1936 | Katz | 297/283.1 |
| 2,715,434 | 8/1955 | Lukens | 297/219.1 X |
| 4,190,918 | 3/1980 | Harvell | 5/420 X |
| 4,729,599 | 3/1988 | Nissen | 297/219.1 |
| 4,854,637 | 8/1989 | McCree | 5/653 X |
| 4,925,241 | 5/1990 | Geraci | 5/420 X |

*Primary Examiner*—Michael F. Trettel

*Attorney, Agent, or Firm*—Christensen O'Connor Johnson & Kindness

[57] ABSTRACT

A seat cushion having means for attaching to a conventional stadium seat is disclosed. The seat cushion includes means for connecting the cushion to a stadium seat. In the preferred embodiment, the connecting means are two straps having a grommet hole therein. A screw or bolt means attaches through the grommet means to the stadium seat. Preferably, the seat cushion is attached to the front of the stadium seat. When in use, the seat cushion lays atop a metal seat. When not in use, the seat cushion can pivot about the attaching connection means and hang off the surface of the metal seat. This allows the cushion to be somewhat shielded from environmental elements when not in use.

3 Claims, 2 Drawing Sheets

STADIUM SEAT CUSHION

FIELD OF THE INVENTION

This invention relates to seat cushions, and more particularly, to a seat cushion that can be fixedly secured to a stadium seat or bench in order to allow a spectator to view an event more comfortably.

BACKGROUND OF THE INVENTION

In most large stadiums, for example baseball or football stadiums, the seats are generally of two types: a bench seat or an individual seat. In both cases, these seats are typically formed of metal. For events lasting several hours, sitting on the hard metal seats for an extended time can be uncomfortable. To alleviate this discomfort, many spectators bring along seat cushions to place on the metal seats. However, many times the spectators may forget to bring along a seat cushion and, in that event, are forced to sit on the metal seats.

Alternatively, some newer stadiums include seats that have cushions integral with and fixedly attached to the seats. These cushions, while effective, are relatively expensive to manufacture and do not have the durability desired. In particular, because the seat cushions are in a horizontal position exposed to the elements in an outdoor stadium, the cushions are exposed to wind, rain, and other environmental conditions that tend to severely degrade the cushion.

SUMMARY OF THE INVENTION

A seat cushion having means for attaching to a conventional stadium seat is disclosed. The seat cushion includes means for connecting the cushion to a stadium seat. In the preferred embodiment, the connecting means are two straps having a grommet hole therein. A screw or bolt means attaches through the grommet means to the stadium seat. Preferably, the seat cushion is attached to the from of the stadium seat. When in use, the seat cushion lays atop a metal seat. When not in use, the seat cushion can pivot about the attaching connection means and hang off the surface of the metal seat. This allows the cushion to be somewhat shielded from environmental elements when not in use.

In one disclosed embodiment, the seat cushion is constructed of an expanded polyurethane foam. Also, the seat cushion includes a moisture-impervious cover, such as a surface layer or skin of high-density polyurethane foam or other material. Further, the seat cushion of the present invention can be retrofitted to existing stadiums having metal seats without the need to replace the seat altogether.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

Figure 1:
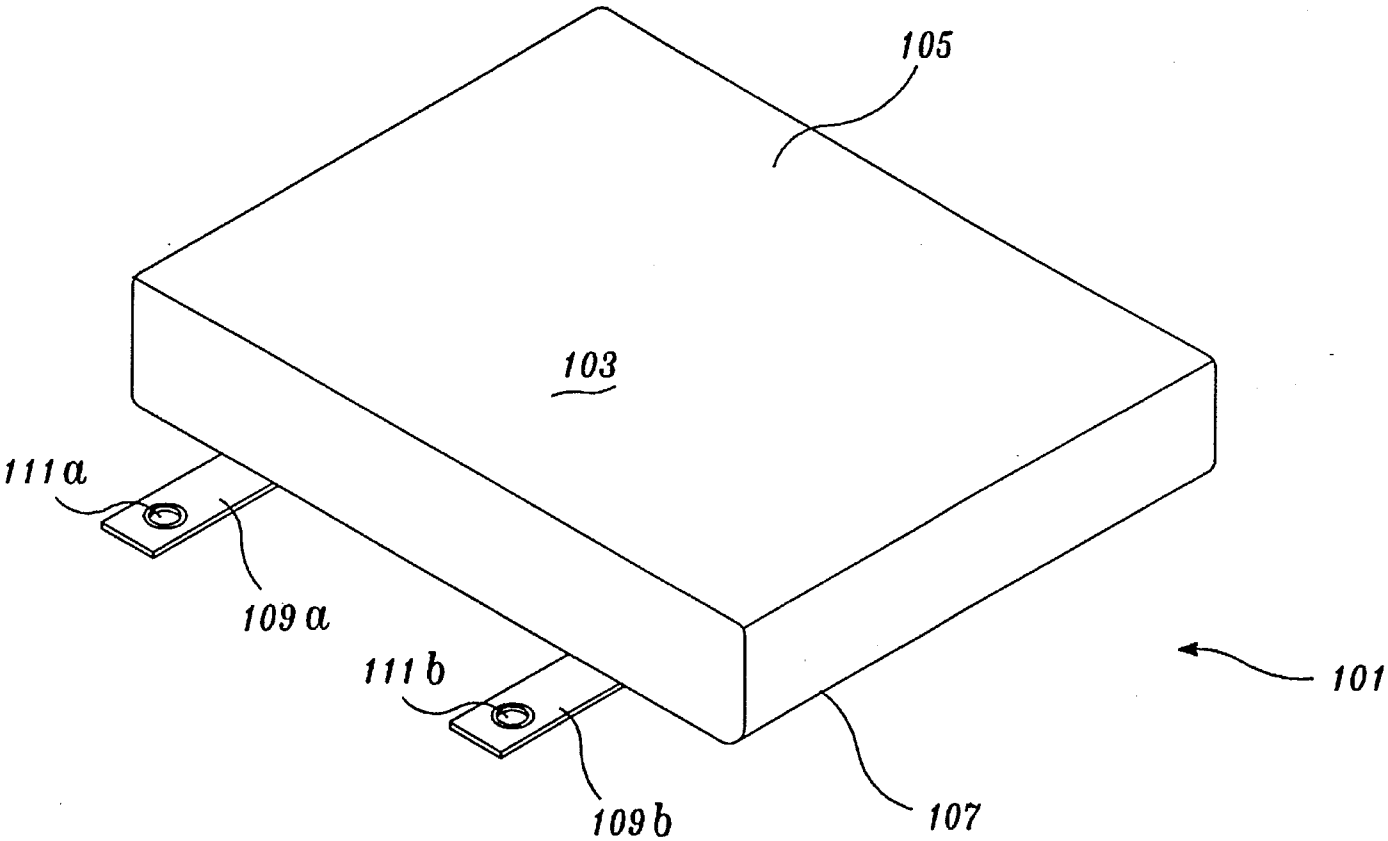
FIG. 1 is a perspective view of a seat cushion that is constructed in accordance with this invention.

As seen in FIG. 1, a stadium seat cushion 101 has a body 103 and two securing straps 109*a* and 109*b*. The body 103 has a top seating surface 105 and a bottom surface 107. The body 103 is a compressible unitary core made to substantially rectangular geometry. Various materials and methods of construction can be employed to produce body 103 that exhibits the desired compressible and resilient qualities for seating comfort. Regardless of the material employed, the thickness of the body 103 should be sufficient to provide adequate cushioning for a person of average weight. In the preferred embodiment, the thickness of body 103 is between two and three inches. One material suitable for use in constructing body 103 is a polyurethane foam core. Further, the body 103 may be covered by a weather-resistant rubberized slipcover which protects the stadium seat cushion 101 from environmental effects. Alternatively, the upper surface regions or the entire surface of the body 103 can be coated with a moisture-impervious material by dipping, spraying or other conventional techniques.

Securing straps 109*a* and 109*b* each include a grommet 111*a* and 111*b* respectively. These grommets define a circular hole through straps 109*a* and 109*b* and are preferably fitted with a metal grommet. Securing straps 109*a* and 109*b* are preferably formed from flexible high impact nylon and are preferably between 2–4 inches long and 1 inch wide.

Figure 2:
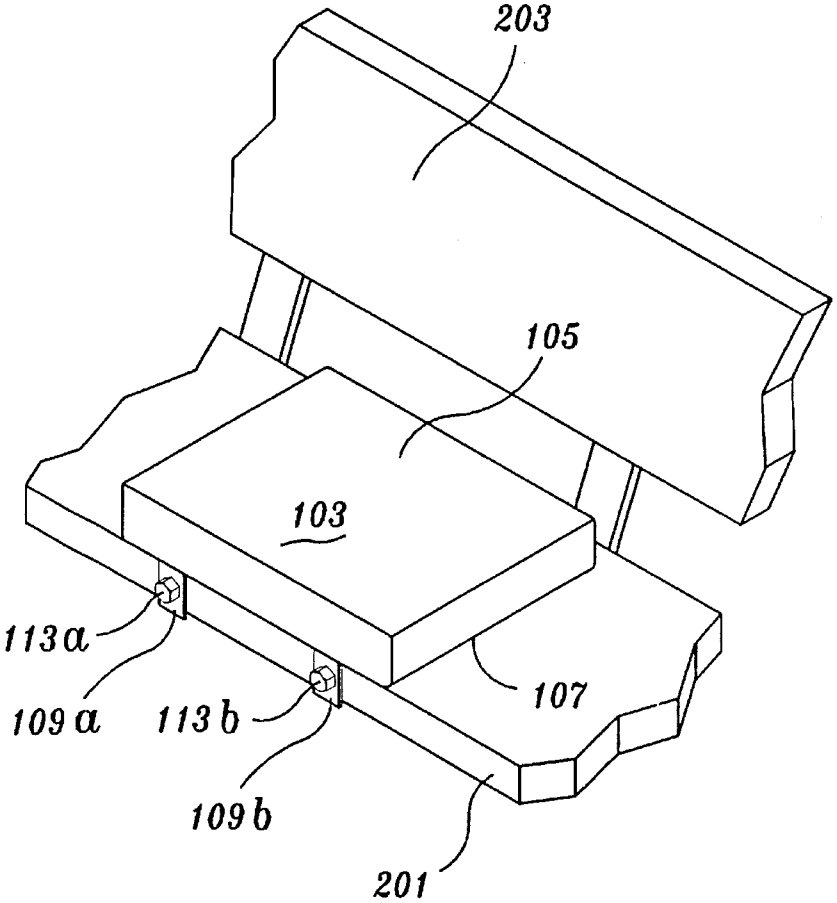
FIG. 2 is a perspective view of the seat cushion attached to a stadium seat in a first position.

Turning to FIG. 2, the stadium seat cushion 101 is shown attached to a bench seat commonly found in outdoor sports stadiums. One advantage of the seat cushion of the present invention is that it can be easily retrofitted to existing stadium seats. The bench seat includes a seating bench 201 and a backrest 203. The stadium seat cushion 101 secures to the bench 201 by means of securing straps 109*a* and 109*b*. In particular, the body 103 is placed atop the bench 201 such that the bottom surface 107 of body 103 is in contact with the seating surface of bench 201. Straps 109*a* and 109*b* are draped over the front surface of bench 201. A securing bolt 113*a* is driven through grommet 111*a* and into bench 201. Similarly, securing bolt 113*b* is driven through grommet 111*b* into bench 201. In the position shown in FIG. 2, the body 103 rests on top of bench 201 such that a spectator can sit on body 103.

Figure 3:
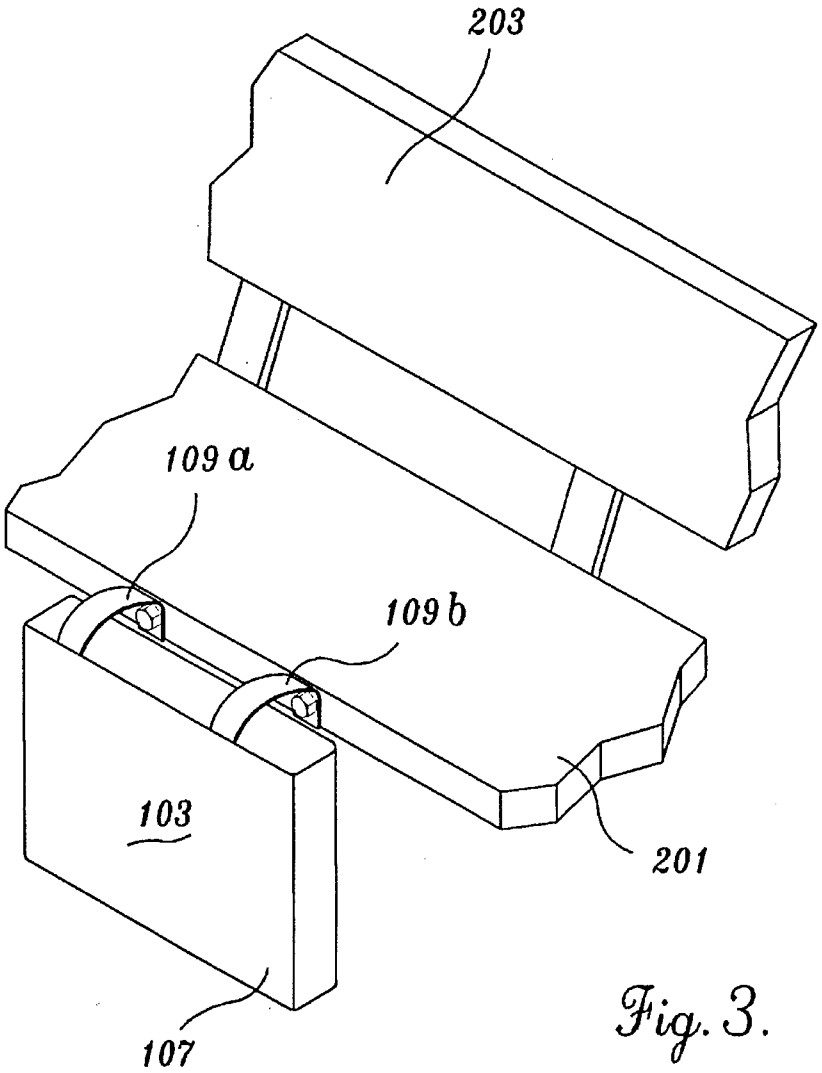
FIG. 3 is a perspective view of the seat cushion attached to the stadium seat in a second position.

When the sporting event is complete, and the spectator no longer needs the stadium seat cushion 101, the body 103 can be folded off the bench 201 as seen in FIG. 3. Preferably, the securing straps 109 are made of a flexible nylon material allowing the body 103 to fold down from bench 201. The body 103 nevertheless is still secured to bench 201 by means of bolts 113*a* and 113*b*. However, because the body 103 is hanging vertically in relation to bench 201, the environmental wearing on body 103 is minimized. Moreover, undesirable staining and soiling from avian droppings can be avoided.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. A stadium seating system installed at a stadium comprising:

(a) a stadium seat fixedly secured to said stadium; and (b) a seat cushion secured to said stadium seat, said seat cushion comprising (i) a deformable body formed from a cushioning material; and (ii) at least one securing strap fixedly attached to said body, said securing strap formed from a flexible material, said securing strap including a securing grommet, wherein said seat cushion is secured to said stadium seat by said securing strap and said securing grommet by driving a securing bolt or pin through said securing grommet into said stadium seat whereby said securing strap, at the point of said securing grommet, fixedly attached to said stadium seat such that said body can be placed in a first position resting atop said seating surface of said stadium seat for the cushioning of a sitting spectator, wherein said stadium seat cushion is capable of being placed in a second position such that said body is disposed away from said seating surface of said stadium seat such that said body is hanging orthogonally in relation to said seating surface of said stadium seat.

2. The stadium seat cushion of claim 1 wherein said stadium seat includes two said securing straps and wherein said securing straps are adapted to be secured to the front edge of said stadium seat.

3. The stadium seat cushion of claim 2 wherein said securing straps are formed from nylon.

* * * * *